US006073813A

United States Patent [19]

Tanner

[11] Patent Number: 6,073,813

[45] Date of Patent: Jun. 13, 2000

[54] PLASTIC BOTTLE

[75] Inventor: Hans-Peter Tanner, Gossau, Switzerland

[73] Assignee: S. Kisling & Cie. AG, Zürich, Switzerland

[21] Appl. No.: 09/146,929

[22] Filed: Aug. 25, 1998

[30] Foreign Application Priority Data

Aug. 26, 1997 [CH] Switzerland ..... 1988/97
Jul. 14, 1998 [CH] Switzerland ..... 1499/98

[51] Int. Cl.[7] ..... B65D 83/14

[52] U.S. Cl. ..... 222/209; 222/552

[58] Field of Search ..... 222/209, 206, 222/215, 552, 554, 563

[56] References Cited

U.S. PATENT DOCUMENTS 2,281,738 5/1942 Wolcott ..... 222/209
3,145,879 8/1964 Williams ..... 222/184
3,245,174 4/1966 Gardel et al. ..... 222/209
5,823,399 10/1998 Gartner ..... 222/209

FOREIGN PATENT DOCUMENTS 0 412 285 6/1990 European Pat. Off. .
1 242 602 12/1959 France .
2 687 568 2/1992 France .
203567 6/1939 Switzerland .

*Primary Examiner*—Steven O. Douglas
*Attorney, Agent, or Firm*—Pauley Petersen Kinne & Fejer

[57] ABSTRACT

A bottle manufactured by injection molding techniques for use with liquids which diffuse greatly. The bottle and a cap are of almost continuous double-walled construction. Two concentric walls extend from the container shoulder, wherein an inner container wall is shorter than an outer container wall. The single-walled or double-walled bottom is shaped in such a way that the inner container wall is sealed by contact on the inside and the outside, while the outer container wall is only sealed by interior contact at the bottom.

12 Claims, 1 Drawing Sheet

PLASTIC BOTTLE

BACKGROUND OF THE INVENTION

1. Field of the Invention

This invention relates to a bottle for reception and metered delivery of liquids, produced from plastic using injection molding techniques and having a cap.

2. Description of Prior Art

Various liquids are known, which are only required in small amounts, in addition are light-sensitive and have a high coefficient of diffusion and permeation, which are diffused easily. Decomposition products or oxidation can occur under the effects of light, while diffusion can alter the composition of the product. For example, the concentration of effective agents in a medicament can be increased to an alarming degree because of the evaporation of the solvent. In any case, the shelf life of the packaged goods is affected by the packaging.

Although glass containers are good barriers for diffusion, the impermeability to light can only be produced by expensive special glass. It is then necessary to employ pipettes for metering the contents, which are extremely expensive and have further problems regarding gas diffusion in the area of the bellows.

Accordingly, plastic bottles are therefore indicated as an alternative. Most of the plastics which can be used in injection molding or blowing technology do not have particularly high values regarding light impermeability and permeation and diffusion density. Because of the three permeation steps, namely absorption, diffusion and desorption, generally diffusion alone determines speed, only diffusion will be addressed in the following specification, however, without ruling out absorption and desorption. If methods of injection molding technology are used, it is possible to appropriately increase the wall thickness. However, in this case the container becomes rigid to such an extent that liquid can only be removed using a pipette.

A further alternative lies in blowing plastic bottles in several layers. Two-layered or three-layered bottles with appropriate blocking layers can thus be produced in this way. All of these have the same overall wall thickness. Such containers are relatively expensive and appropriate machines are required, which are only available at all in a few plastic-processing companies. Although the squeezable plastic bottles permit metering of the liquid, this is only possible with a very light touch. Since the wall thickness of blown containers is generally consistent, the container is deformed over the entire container wall when it is squeezed. This makes dispensing of small amounts more difficult.

SUMMARY OF THE INVENTION

It is therefore one object of this invention to produce a bottle made of plastic by injection molding technology which avoids the above mentioned problems.

This object and others are obtained by a bottle of the type mentioned at the outset, having characteristics as described below in the specification and claims.

A preferred embodiment variation of the subject of the invention is represented in the drawings and explained in detail in the following description.

DESCRIPTION OF PREFERRED EMBODIMENTS

Figure 1:
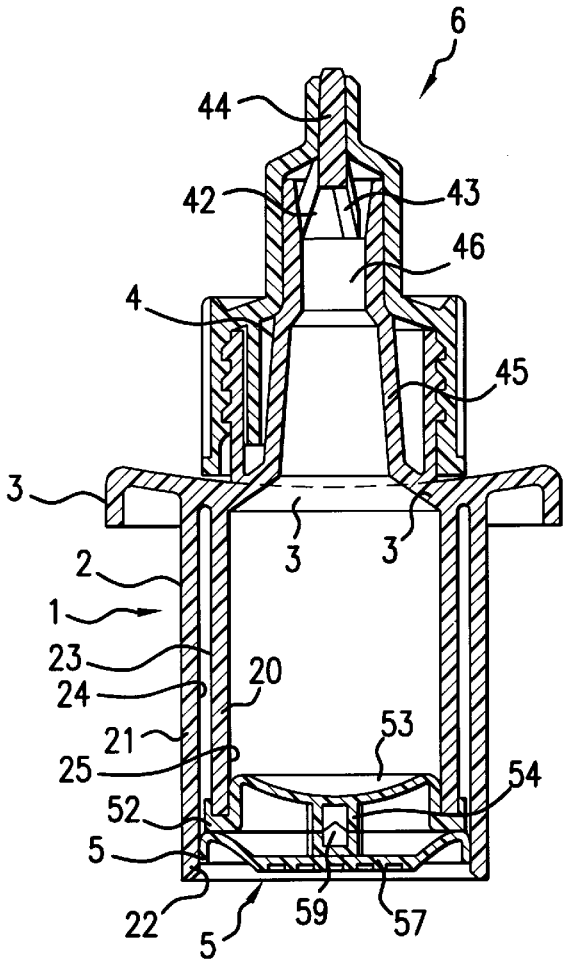
FIG. 1 is a central vertical sectional view taken through a bottle with a cap in a closed state, according to one preferred embodiment of this invention.
Figure 2:
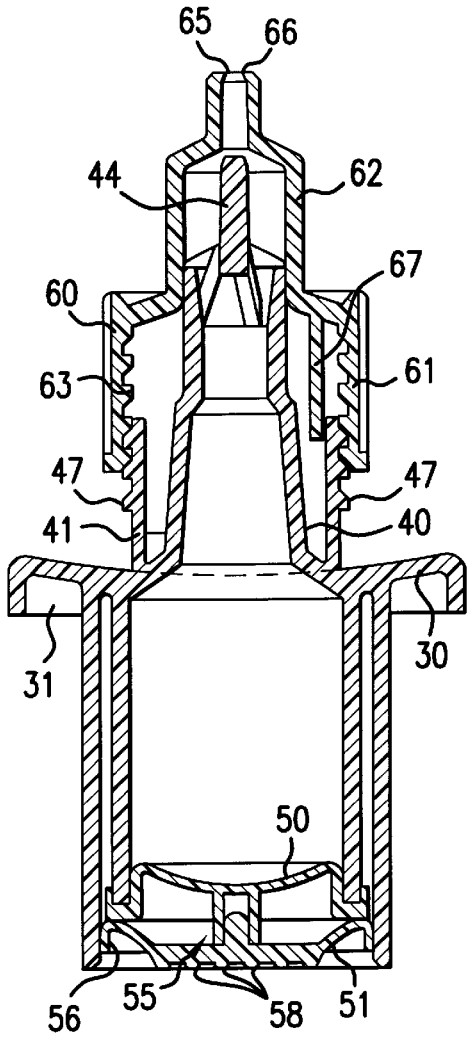
FIG. 2 is a central vertical sectional view as shown in FIG. 1 but with the cap in an opened state.

The bottle 1 in accordance with this invention has a general structure similar to conventional bottles made of plastic. The bottle 1 comprises a container 2, with a hollow space for receiving liquid, which makes a transition via a shoulder 3 into the bottle neck 4. The bottle 1 is sealingly closed at the lower end by a bottom 5, and at the top end by a cap 6 which is screwed on the bottle neck 4.

Two concentrically arranged walls 20 and 21 extend downward to the bottom 5 from the shoulder 3. The two concentric walls 20 and 21 basically can have any arbitrary shape, so that the hollow space they are enclosing can be cubical, cylindrical or have a shape which is oval in cross section. However, for reasons of processing technology, the inner wall 20 and the outer wall 21 extend parallel. The outer wall 21 preferably extends further downward than the inner wall 20. The inner wall 20 and the outer wall 21 extend at a distance from each other, wherein the wall thickness conically decreases from the shoulder 3 toward the bottom 5, so that the distance between the facing surfaces 23, 24 of the walls 20, 21, respectively increases from the top to the bottom 5. On the lowermost end, the outer wall 21 has a slightly inward protruding annular bead 22, which is used to hold the bottom 5.

The bottom 5 of the bottle 1 is made of two elements 50, 51, which together form a flexible, resiliently deformable double-walled bottom. The two elements 50 and 51 are diaphragm-like and do not rest on each other over their entire surfaces, but only along the periphery, i.e. at the edge. In this way the two elements 50 and 51 together comprise a spigot-like hollow body. The inner or upper element 50 is a cup with an edge 52 which is designed such that it can interlockingly extend around the inner wall at the end and thereafter is pulled upward along a distance over the inner surface 25 of the inner wall 20. The actual surface 53 of the cup is flanged toward the outside, when viewed with respect to the hollow space of the container 2. A pin-shaped, outwardly protruding shoulder 54 is applied by injection molding on the outer surface, is centered on the inner element 50, and is part of a contact place 55 acting as the connection between the inner element 50 and the outer element 51.

The outer element 51 is also shaped in the form of a cup if the walls 20, 21 of the container 2 are cylindrical. Viewed from a contact plane between both of the elements 50, 51, the cup has an outer, downwardly protruding edge 56 which, in the assembled state of the bottle, i.e. in particular when both elements 50, 51 comprising the bottom 5 are inserted, rests on the annular bead 22 on the inside surface of the outer container wall 21. From the contact plane with the inner element 50, the edge 56 transitions into a thinner diaphragm surface 57, which is flanged outward from the contact plane, but not past the lower edge of the outer container wall 21. The diaphragm surface 57 is flattened, centered at the top and has a concentric ribbing 58, which indicates the outer pressure surface. On the inside, the diaphragm surface 57 has an upward oriented pointed pin 59, which in the assembled state protrudes into the hollow shoulder 54, so that an interlocking frictional connection place 55 between the upper, inner element 50 and the outer, lower element 51 of the bottom is created.

The bottle neck 4 is preferably designed with double walls. The inner wall 40 of the bottle neck 4 extends directly from the shoulder 3 and is sealingly and in one piece connected with the shoulder 3. The inner bottle neck finally terminates in the nozzle-shaped spout 42, in which a sealing pin 44 is maintained, spaced apart from the center by strips 43 and acts together with the cap 6 of the bottle 1. The sealing pin 44 and the strips 43 are also injection-molded in one piece with the bottle neck 4, the shoulder 3 and the container 2. The bottle neck 4 has two zones, namely a tapering zone in which the bottle neck 4 narrows from the shoulder 3 to the width of the spout 42, and a sealing zone 46, in which the bottle neck 4, together with the cap, forms a cylindrical sliding seal.

An outer wall 41 extending vertically upward from the shoulder 3 is concentrically offset toward the outside. However, the outer wall 41 only reaches as far as the height of the start of the sealing zone 46. This outer wall 41 has an exterior thread 47.

The arrangement of the exterior thread 47 for fastening the cap 6 on a separate cylindrical wall allows a high degree of accuracy of the measurements, so that additional tightness is achieved, although this seal is only of tertiary importance.

The cap 6 is formed by an actual screw top 60, which cooperates with the sealing pin 44. Similar to the bottle neck 4, the screw top 60 also has two areas, namely the lower fastening area 61 with an interior thread 63 which cooperates with the exterior thread 47 of the outer bottle neck wall 41, and a sealing area 62 above and connected in one piece with the screw top 60. The interior surface of the sealing area 62 forms an extremely well-fitted sliding seal with the outer surface of the sealing zone 46 of the bottle neck 4. At the top the screw cap 60 terminates in a pouring spout 64. The pouring spout 64 narrows conically toward the opening 65, wherein the tapering angle is slightly greater than the tapering angle of the also conical sealing pin 44. In addition, the inner edge of the opening 65 is designed as a sealing lip 66.

Thus, the bottle 1 so far described has double walls from the bottom 5 to the top. This is accomplished because the bottom 5 comprises the outer bottom element 51 and the inner bottom element 50, the container 2 comprises the inner container wall 20 and the outer container wall 21, the bottle neck 4 is in the lower fastening zone of the bottle neck 4 by the tapering zone 45 of the bottle neck and the approximately concentric wall 41, and the bottle neck 4 is in the sealing area by the sealing zone 46 of the bottle neck 4 with the sealing area 62 of the screw top 60.

A detent 67 can also be seen in the screw top 60 which, in the attached position, protrudes into the space between the inner and outer walls 40, 41 of the bottle neck 4 and there cooperates with an opposite element, not shown in the drawings, in order to prevent the unintentional unscrewing of the cap 6.

Figure 3:
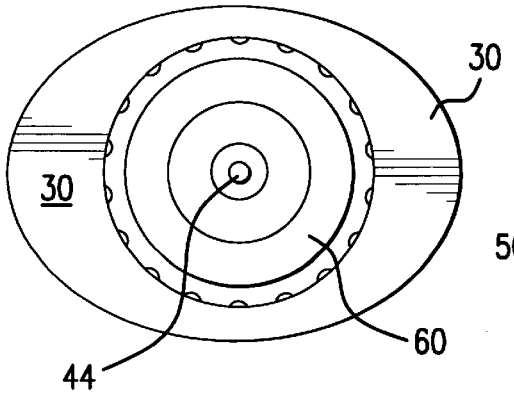
FIG. 3 is a top view of the bottle and the cap, as shown in FIGS. 1 and 2.

Finally, the shoulder 3 of the bottle 1 is also specially designed for the application of interest. As can be seen from the top view in FIG. 3, the shoulder 3 extends over the container wall to the outside and in this way forms an oval restraint 30, which is designed particularly strong because of a downward drawn reinforcement edge 31.

Due to this embodiment, the bottle 1 in accordance with this invention can be grasped in the manner of a syringe. In this case an index finger and a middle finger rest on the restraint 30 protruding on both sides, while the thumb rests on the bottom 5. It is therefore possible to exert an exactly required force on a bottom using a thumb in order to make an exact, drop-by-drop delivery possible, should this be desired.

In accordance with a particularly cost-effective embodiment of this invention, it is possible to design the two diaphragm-like elements 50, 51 so they are connected via a hinge and, if desired, in addition to arrange one of the two elements 50, 51 pivotally on one of the concentric container walls 20, 21. The mutual production of both diaphragm-like elements 50, 51 in one mold is possible. It is only necessary to fold the two elements 50, 51 together prior to assembly.

In spite of the design of the double-walled bottom 5 it is not possible to work with certain materials. Tests have shown that certain adhesives would require too great a wall thickness, so that the required flexibility of the bottom 5 is no longer assured and the material can no longer be pressed on.

Figure 4:
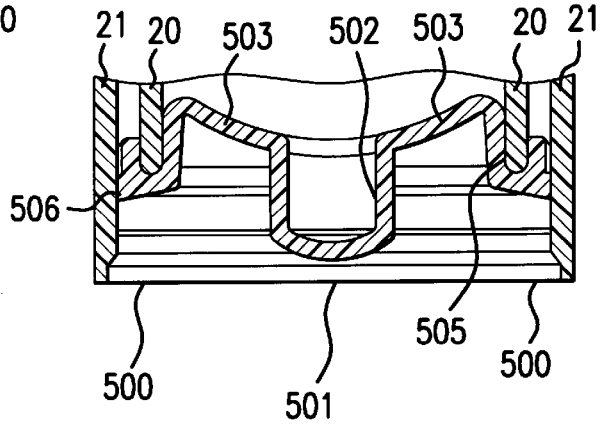
FIG. 4 is a partial axial sectional view taken through a bottom and a lower bottle end of the bottle as shown in FIGS. 1 and 2.

In this connection a remarkable solution has been found which, however, cannot be generally used. As shown in FIG. 4, a single layer, single piece bottom 5 is used. The bottom 5 has a sealing area 500 on the edge which, in comparison with the center area 501 has a considerably increased wall thickness. The center area 501 has a push element 502 arranged centered therein, which projects out of the bottom 5 in the direction of the base but does not reach as far as the lower edge of the outer container wall 21. A concentric annular surface 503, which is arched toward the outside in the direction of the base, extends around the push element 502 and can be inverted by pushing on the push element 502.

The circumferential sealing area 500 follows the concentric annular surface 503. The inner wall 20 of the container 2 lies in the annular groove 504 in the sealing area 500. A first seal is provided by a sealing bead 505 resting against the inside of the inner wall 20. A second seal is provided by a circumferential sealing lip 506 on the peripheral edge of the bottom 5. The sealing lip 506 rests sealingly against the inner wall surface of the outer wall 21.

Although the single-layer relatively thin wall is sufficient for the bottom 5 but is not sufficient for the remainder of the bottle 1 and requires a double wall. Actually, the bottom 5, which only constitutes a small surface of the entire container, does not seal at all. Instead, the thin walls lead to rapid diffusion. Various materials then immediately lead to a reaction at the contact surface with the bottom 5 and thus form a passivating layer. This simple solution can only be realized in connection with certain contents, such as certain adhesives, for example, and only under a condition that the bottom surface is small relative to the entire container surface.

What is claimed is:

1. In a bottle (1) for reception and metered delivery of a liquid, injection molded from plastic and having a cap, the improvement comprising: the bottle (1) having at least one double-walled container (2) closed by a flexible, elastically deformable bottom (5), an outer container wall (21) of the bottle (1) being longer than an inner container wall (20) of the bottle (1), and the bottom (5) extending around the inner container wall (20) on an inner surface and a facing surface and resting against and sealingly closing an inside surface of the outer container wall (21).

2. In the bottle in accordance with claim 1, wherein the bottom (5) is double-walled formed by two diaphragm elements (50, 51) which peripherally rest against each other, and at least one of the diaphragm elements (50, 51) form a seal on the inner container wall (20).

3. In the bottle in accordance with claim 2, wherein each of the diaphragm elements (50, 51) forms a flanged surface.

4. In the bottle in accordance with claim 2, wherein a hinge connects the diaphragm elements (50, 51) with each other.

5. In the bottle in accordance with claim 2, wherein one of the diaphragm elements (50) extends around and along the inner container wall (20), inverted toward an interior of the bottle (1) and thereafter arched toward an exterior of the bottle (1), the other of the diaphragm elements (51) sealingly rests on the inner surface of the outer container wall (21) and extends arched toward the outside, and an arched section of the one diaphragm element (50) projects no further than the outer container wall (21) in an axial direction.

6. In the bottle in accordance with claim 2, wherein the diaphragm elements (50, 51) are connected with each other at least at a center pin-shaped contact place (55).

7. In the bottle in accordance with claim 1, wherein the bottle (1) has a shoulder part (3), from which the inner and outer container walls (20, 21) extend concentrically toward the bottom (5).

8. In the bottle in accordance with claim 7, wherein starting at the shoulder part (3) two approximately concentric, upward oriented walls (40, 41) which are centered and inwardly offset with respect to the inner and outer container walls (20, 21), form a double-walled bottle neck (4).

9. In the bottle in accordance with claim 8, wherein an outermost one of the two walls (40, 41) has an external thread (47) with which a screw top (60) of the cap (6) mates, and a sealing pin (44) which cooperates with the cap (6) is formed on an inside surface of an innermost of the walls (40, 41) of the bottle neck (4).

10. In the bottle in accordance with claim 9, wherein an outermost end of the innermost wall (40) rests against an inner screw top wall (62) of the screw top (60) as a sliding sealing surface, so that in a closed state of the cap (6) the double-wall continues from a pouring spout in the cap (6) to the bottom (5).

11. In the bottle in accordance with claim 7, wherein the shoulder part (3) extends outward (30) at least partially over an outermost of the inner and outer container walls (20, 21).

12. In the bottle in accordance with claim 1, wherein the bottom (5) is of one piece and one layer and has a centered push element surrounded by a concentrically arched annular surface which can be inverted.

* * * * *